United States Patent [19]

Dicks

[11] Patent Number: 4,834,454

[45] Date of Patent: May 30, 1989

[54] OFFICE CHAIR WITH TILTABLE SEAT AND BACK

[75] Inventor: Peter Dicks, Cambridge, Canada

[73] Assignee: Faultless-Doerner Manufacturing Inc., Waterloo, Canada

[21] Appl. No.: 49,845

[22] Filed: May 15, 1987

[51] Int. Cl.[4] ..... A47C 3/00

[52] U.S. Cl. ..... 297/317; 297/319

[58] Field of Search ..... 297/300, 316, 322, 319

[56] References Cited

U.S. PATENT DOCUMENTS

| | | | |
|---|---|---|---|
| 3,139,305 | 6/1964 | Mizelle | 297/317 |
| 3,252,734 | 5/1966 | Berlin | 297/317 |
| 3,337,266 | 8/1967 | Burns | 297/317 |
| 4,558,902 | 12/1985 | Meiller | 297/319 X |
| 4,653,806 | 3/1987 | Willi | 297/300 |

FOREIGN PATENT DOCUMENTS

| | | | |
|---|---|---|---|
| 2026929 | 12/1970 | Fed. Rep. of Germany | 297/319 |
| 714601 | 9/1931 | France | 297/317 |

*Primary Examiner*—Peter A. Aschenbrenner
*Attorney, Agent, or Firm*—Fetherstonhaugh & Co.

[57] ABSTRACT

This invention relates to a chair having a tilting back that tilts rearwardly when the user leans rearwardly and that follows and supports the user's back as he leans forwardly. A lever, swingably mounted to the chair, responds to the specific weight of the user to carry the chair's back forwardly to comfortably support the back of the user without any required adjustment.

2 Claims, 5 Drawing Sheets

OFFICE CHAIR WITH TILTABLE SEAT AND BACK

This invention relates to a chair having a tilting back.

Chairs having backs that tilt rearwardly when the user leans rearwardly and that follow and support the user's back as he leans forwardly again have been known for some time.

The ease or difficulty that the user encounters when leaning rearwardly or forwardly is determined by the forward force exerted by the chair back against the user's back.

In the past, the forward force exerted by the chair back has been controlled by a spring mechanism. The greater the loading of the spring mechanism, the greater the forward force exerted by the chair back against the user's back.

The problem with spring mechanism used for this purpose is that they must be set to suit the particular weight of the user. The forward force of the chair back required by a heavier person is greater than it is for a lighter person.

To obtain a different loading of the spring, an adjustment is required. This adjustment is a nuisance to make and it is not uncommon that a user will not bother making the adjustment, instead choosing to sit in a chair having a chair back that urges itself against their body with an unsuitable force.

There is a need for a chair having a tilting back that responds to the weight of the user to provide its tilting back with a forward force to comfortably support the back of the user without any required adjustment.

This invention provides a chair that automatically sets the tilting action of the back rest to suit the individual seated by responding to the specific weight of that individual to provide optimum comforting pressures without adjustment. The person's weight as he sits on the chair, determines the proper comforting pressure to accompany the tilting action.

According to one aspect of this invention, a chair comprises a base, a seat, a back, a lever fulcrumed about an axis on the base; the back being mounted on the lever; the seat being mounted on the base for movement with respect thereto and to exert a force proportional to the weight against one end of the lever in the seat whereby to turn the lever about its fulcrum and urge the other end of the lever which carries the back against the back of the user with a force that depends on the weight of the user on the seat.

In use, the lever moves about its fulcrum on the base to press the back of the chair, which is on one end of the lever against the back of the occupant as a result of the occupant's own weight applied to the seat. The seat bears against the other side of the lever. The tilting force of the back of the chair is proportional to the occupant's weight and no adjustment is required for persons of different weight.

According to another aspect of this invention, a seat mounting assembly of a chair for connecting the seat to the leg assembly comprises: a seat support; a base; a lever; the lever being mounted about a fulcrum axis on the base; the seat support being mounted to the base for movement with respect thereto and to transfer a force against one end of the lever, the other end of the lever being connectible to the back of a chair whereby a force can be applied to the back of a chair in response to a force applied by the seat to one end of the lever.

The invention will be fully understood after reading the following description given in conjunction with the drawings in which.

Figure 2:
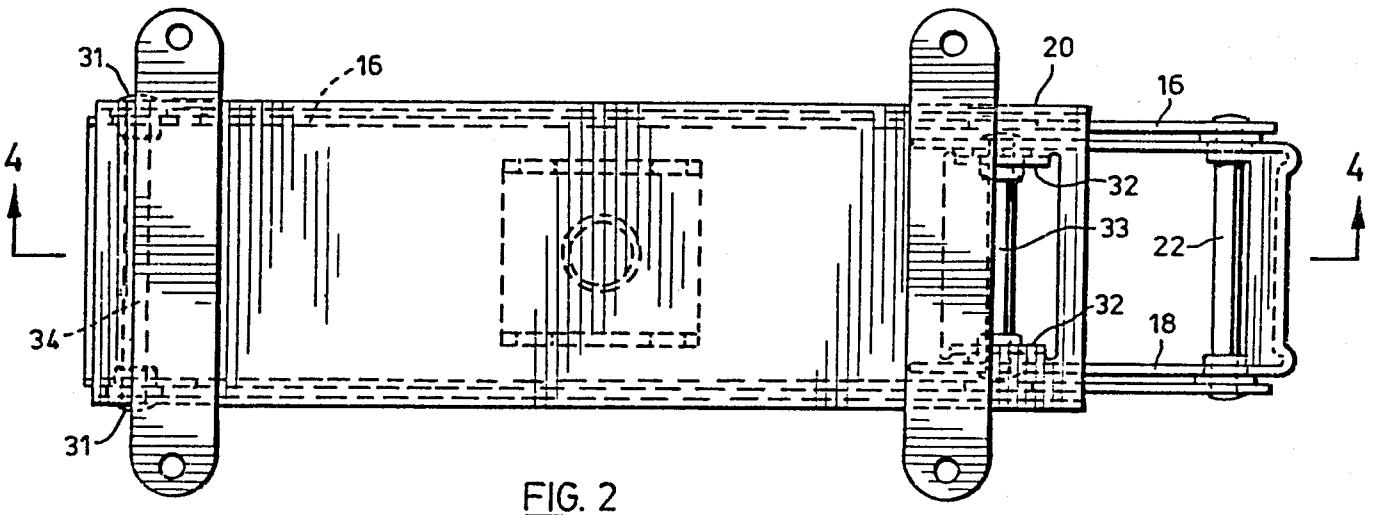
FIG. 2 is a plan view of the seat support assembly.
Figure 4:
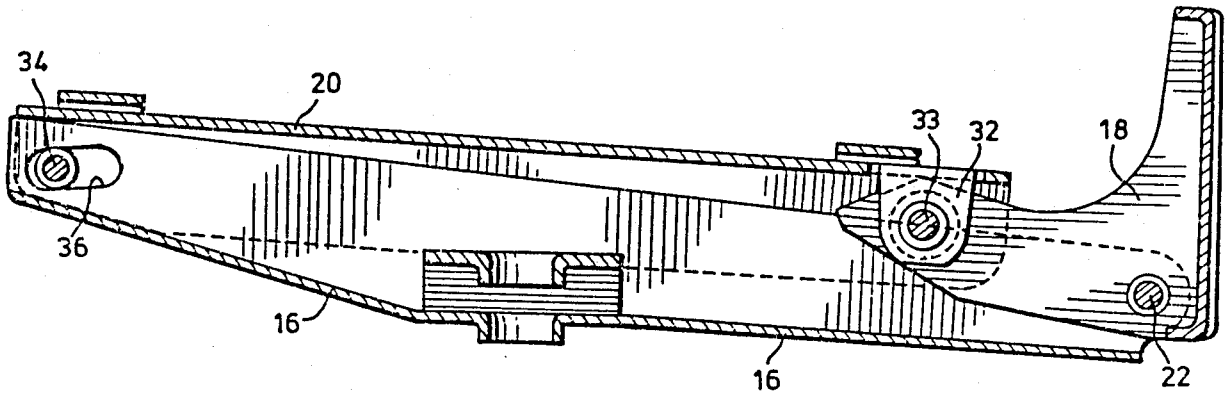

FIG. 4, a longitudinal cross-section taken along 4—4 of FIG. 2 showing the lever in an intermediate position.

Figure 5:
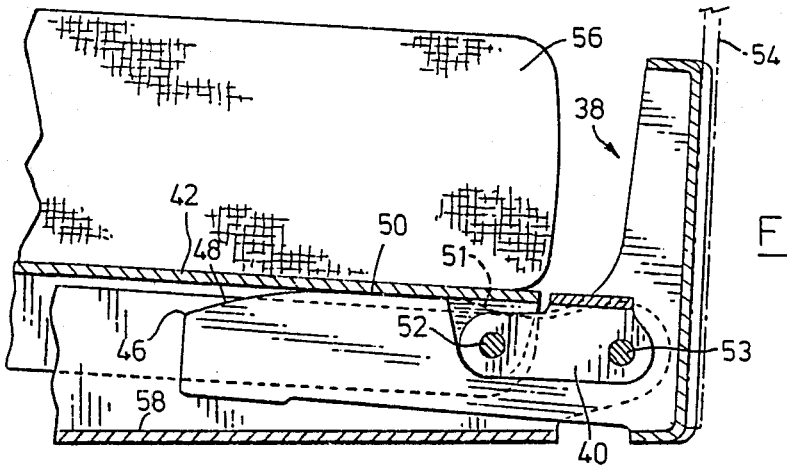
Figure 6:
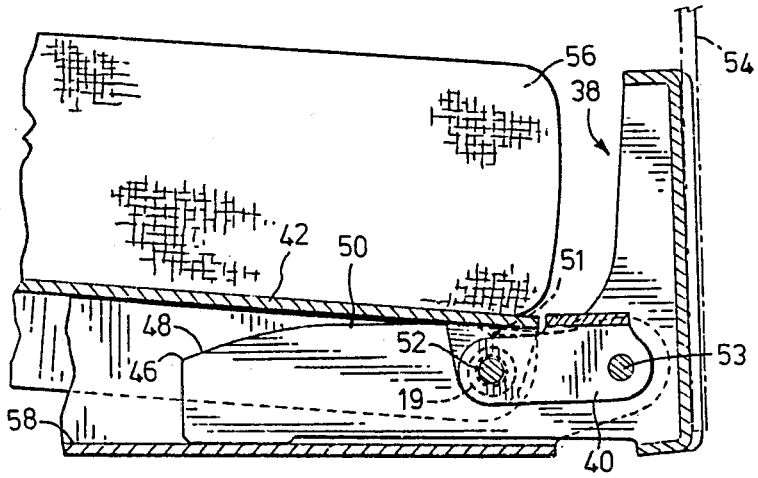
Figure 7:
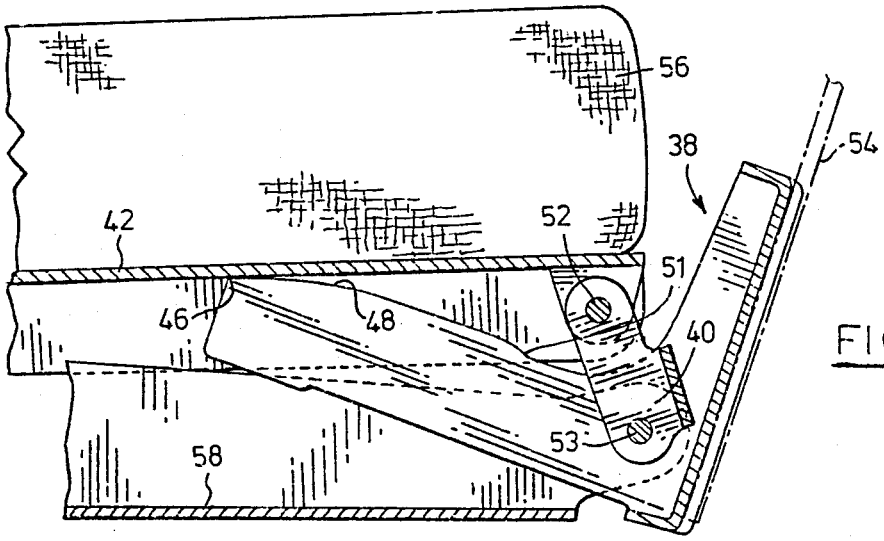

FIG. 5 is a longitudinal cross-section of a second embodiment showing a lever having lower arm with a cam surface, the lever being positioned in an intermediate position;

FIG. 6 is a longitudinal cross-section of the second embodiment showing a positioning of the lever's lower arm and cam surface as the chair back is being moved toward its most forward position from the intermediate position shown in FIG. 5; and FIG. 7 is a longitudinal cross-section of the second embodiment showing a positioning of the lever's lower arm and cam surface as the chair back is being moved toward its most rearward position from the intermediate position shown in FIG. 5.

The chair illustrated has a leg assembly 10 from which four castered legs extend to support it on the floor. A threaded stem 12 extends from the leg assembly and can be screwed upwardly or downwardly with respect to the leg assembly to adjust the height of the seat 14.

The seat 14 is mounted to the top of the stem 12 by means of a seat mounting assembly that has a base 16, an L-shaped lever 18 and a seat mounting bracket 20.

The base 16 of the seat mounting assembly is made of steel. It is elongated and channel-like in cross-section. It is mounted on the top of the stem 12.

Seat mounting bracket 20 is bolted to the under side of the seat as at 30. It is of channel-like cross section and the sides of the channel extend over the base member 16. Lugs 32 extend downwardly from the bottom of the channel and are connected at their free ends to the sides of the channel-like lever member 18 by the shaft 33. Thus the seat mounting bracket pivotally connects with an arm of the L-shaped lever 18.

The other end of the seat mounting bracket 20 has a shaft 34 extending between its sides that extends through a longitudinally extending slot 36 in the seat mounting bracket.

The seat mounting bracket 20 is a seat support designed to give good support to the seat which it carries and also to give stability to the movement of the unit. Flanged rollers extend around the ends of shaft 34 with the flanged portion extending between the sides of the seat mounting bracket 20 and the base member 16 as illustrated in FIG. 2.

The lever 18 of the seat mounting assembly is also fabricated from steel. The lever 18 is L-shaped in longitudinal section and channel-like in cross-section. It is mounted for movement about a fulcrum shaft 22 that is supported by the sides of the base member 16 of the seat mounting assembly.

The back 24 of the chair is mounted on a support arm 26, which in turn is retained in clamp 28 on the upper arm of the L-shaped lever 18.

Thus one end of the lever 18 carries the back 24. The other end of the lever 18 is pivotally connected to the seat mounting bracket 20 of the seat mounting assembly by means of a pair of lugs 32 which depend downwardly from the bracket 20 and connect with the sides of the lever 18 by means of pin 33.

It will be apparent that with the back in the rearward position and weight applied to the seat 14, the end of the lever 18 to which the seat mounting bracket 20 connects will tend to move downwardly. As it does, the seat mounting bracket 20 will slide forwardly of slot 36 in the base 16 as the flanged rollers 31 roll over the edges of the slot. At the same time, the back 24 and its support arm 26 will tend to move forwardly against the back of the person sitting in the chair.

The lever 18 has two stop positions: a rearward stop position and a forward stop position.

Figure 3:
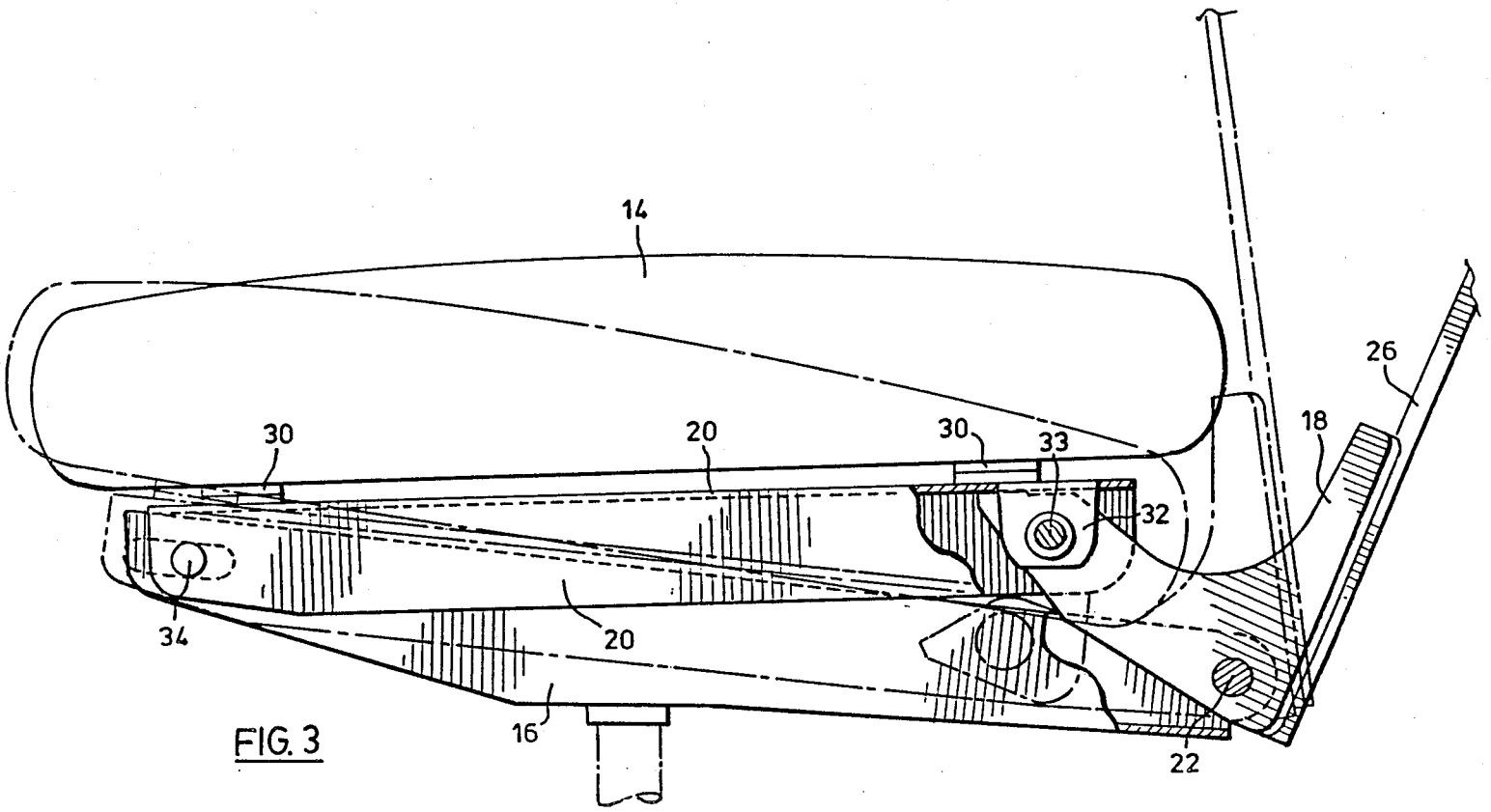
FIG. 3 is a partial side view of the chair partly broken away to illustrate the connection of the seat mounting bracket and lever.

The rearward stop position is reached when the forward tip of the L-shaped lever 18 contacts the bottom of the seat mounting bracket 20 as shown in FIG. 3.

Figure 1:
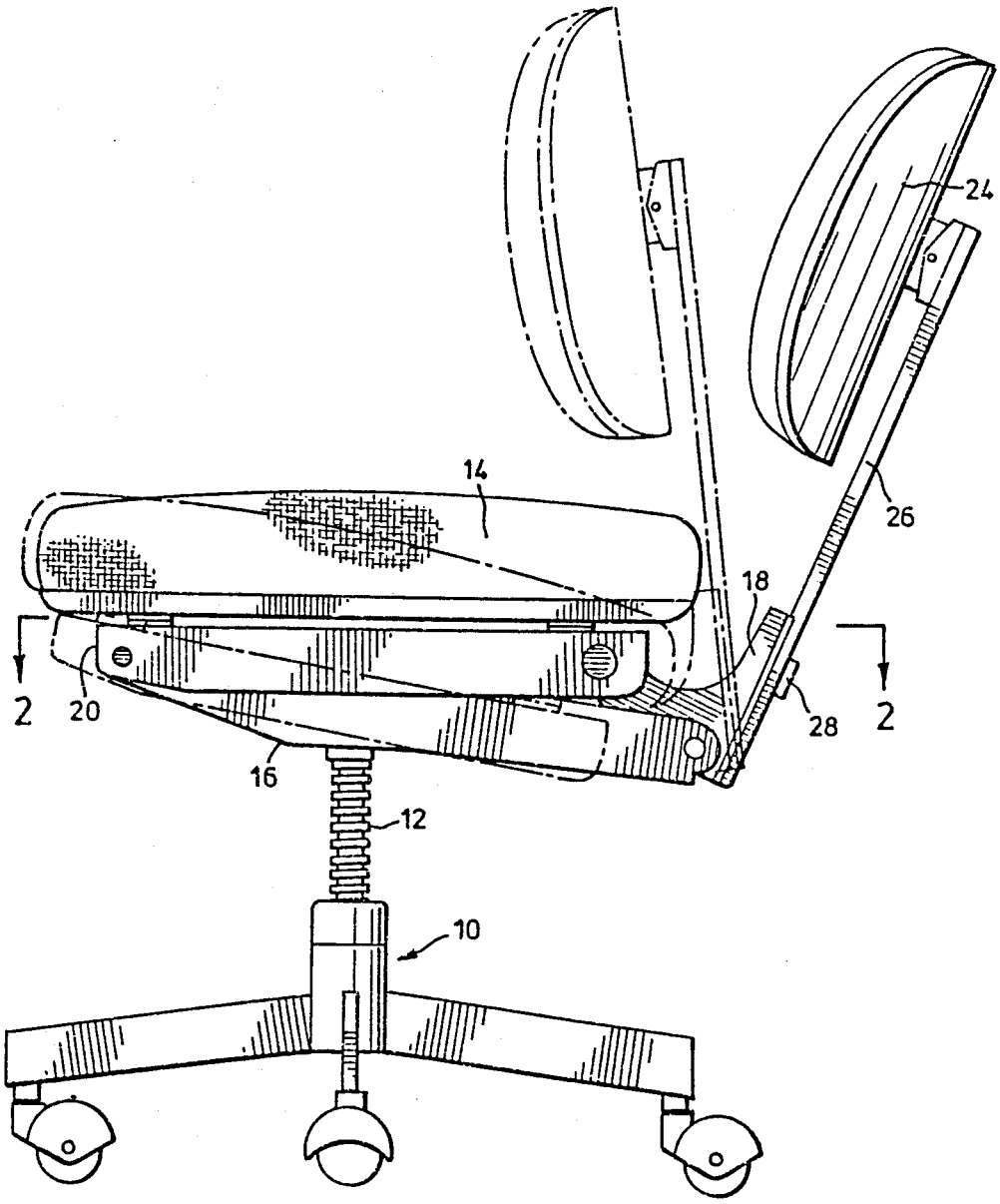
FIG. 1 is a perspective view of a first embodiment of a chair made according to this invention with the chair back tilted to its most rearward position but also showing the chair back tilted to its most forward position in phantom lines.

The forward stop position is reached when the upper arm of the L-shaped lever 18 contacts the rear edge of the seat 14 as shown in phantom in FIG. 1.

Means for controlling the limiting extremities of the lever movement in either direction are variable. It is merely a matter of providing a stop means for the movable parts where required.

Thus, it will be apparent that when a load or weight is placed upon the seat member, a downward force is transmitted through the lugs 32 to one end of the L-shaped lever 18. This causes the lever 18 to tend to pivot about its pivot point and force the other end of the lever, which carries the back, in a forward direction. At the same time, the forward end of the seat supporting bracket moves forwardly of he slot.

A downward force on the forward end of the L-shaped lever 18 is proportional to the weight of the person sitting on the seat and the force tending to urge the back rest 24 of the chair towards the user will be proportional to the weight of the user.

In use, the lever responds to the weight forces exerted by the seated occupant to provide a tilting chair back that comfortably supports the back of the occupant.

The weight bearing down on the seat and the weight exerted by the user's back against the chair back are the forces, each exerted against an opposing end of the lever, that determine the position of the chair back. The weight, exerted by the user's back, required to overcome the weight bearing down on the seat to tilt the chair back rearwardly, is less than the weight bearing down the seat because the distance between the back and the fulcrum axis is greater than the distance between the end of the lower arm and the fulcrum axis.

When the user is seated, he leans rearwardly and exerts a force against the chair back that moves the lever about its fulcrum until the lower arm of the lever engages the seat supporting bracket and the chair back is stopped in its most rearward tilt position as shown in FIG. 1. When the user leans forwardly, the user's weight, bearing down on the seat, moves the lever forwardly about its fulcrum to carry the back forwardly and provide comfortable support to the user's back.

The weight of the occupant bearing down on the seat provides a constant force acting on the lever during use. This is a regulating force that ensures the back of the chair will always, in use, be hugged forwardly to provide support for the user's back with a force proportional to the user's weight. The heavier the user, the more support desired and the more support provided because the weight bearing down on the seat will be greater. Similarly, the lighter the user, the less support desired and less support provided because the weight bearing down on the seat will be less.

When the user gets up from sitting on the chair, the chair back is most likely to be left tilted in its most forward position because, in leaving the chair, the user customarily leans forwardly before rising, thereby bringing the back of the chair forward.

It will be noted that as a person sits down in the chair and the back tilts rearwardly that the back of the seat moves upwardly due to the clockwise movement of the lever. This is an adjustment that adds comfort to the use of the chair.

It will be apparent that the lever need not be L-shaped. For example, one might have a lever that is straight in combination with some kind of a linkage or camming mechanism for loading the lever to achieve the action described. A lever that is L-shaped and that has an arm underlying the seat is convenient, but it is not the only way of achieving the principal of the invention.

It will also be apparent that the base 20 could be pivotally connected to the base at the front and a sliding movement provided at the interconnection of the lugs 32 and the pin 33. Pivotal and sliding movement is necessary but the means of achieving it can vary.

The stop means can be anywhere on the chair or seat mounting assembly.

A system of links intermediate between the seat and the lever may also be used in combination with a lever that is L-shaped.

The second embodiment illustrated in FIGS. 5–7 principally differs from the first embodiment illustrated in FIGS. 1–4 in two respects.

Firstly, it includes a lever, generally referred to by the numeral 38, with an upper cam surface provided on its lower arm and, secondly, it includes a link 40 swingably connected between the seat support 42 and the elbow of the lever.

Similar to the embodiment illustrated in FIGS. 1–4, the lever 38 is channular in cross-section.

With regard to the cam surface, there is provided a forward edge 46, a forward convex portion 48, a middle flat portion 50 and a rearward convex portion 51.

As the chair back 54 is tilted rearwardly, the point of contact between the underside of the seat and the cam surface moves forwardly.

Depending on whether forward edge 46, forward convex portion 48, flat portion 50, or rearward convex portion 51 of the cam surface is pressing against the underside of the support 42, the force require to tilt the chair back 54 rearwardly will vary. In the embodiments shown in FIGS. 5–7, the force required to tilt the chair back rearwardly increases as the cam surface pressing against the underside of the seat changes from the rearward convex portion 51 to the flat portion 50, from the flat portion 50 to the forward convex portion 48, and from the forward convex portion 48 to the forward edge 46.

When the user sits down on the seat 56, the chair back 54 will be urged forwardly toward the user's back because the increased downward force caused by the user's weight is transmitted from the seat support 42 directly to the lower arm of the lever. Looking at the FIGS. 5–7, the downward force urges the lever in the counterclockwise direction about its fulcrum axis. The downward force of the user's weight is counterbalanced by the user's back exerting a force against the chair back 54 to move the lever in the clockwise direction about the fulcrum axis at shaft 53 to push the cam surface o the lower arm upwardly against the underside of the second end of the seat support.

One may achieve different effects by varying the slope of the cam surface. The precise cam surface described in this specification and shown in drawings 5–7 is shown for example only.

With regard to the link 40, the link 40 ensures that as the chair back 54 is tilted rearwardly, the seat 56 moves rearwardly with respect to the base 58. The practical benefit of this rearward movement of the seat is that it reduces the amount of slide of the chair back against the back of the occupant. Excess slide of this type can cause an uncomfortable pulling of the occupant's shirt as he leans rearwardly.

Because the lower arm of the lever pushes the seat upwardly as the chair back is tilted rearwardly, the level of the seat rises. The seat and the back therefore move, but not in similar directions. Without the link 40, in practicality, the chair back 54 moves further away from the seat 56 as the back is tilted rearwardly so that their separation distance varies. By providing a link 40, this variation is reduced and at least some of the sliding action is transferred from the back of the chair to the lever's lower arm. Because there is now a sliding of the lever's lower arm against the underside of the seat when the link is used, it is preferable that at least one of the sliding surfaces be made from a plastics material. For instance, the lower arm of the L-shaped lever may be made from a plastics material. Alternatively, if the lower arm of the L-shaped lever is metal, a plastic sheet underlying the seat support may be used to provide the sliding surface for the lever's lower arm as the lever is being urged about its fulcrum axis. A metal to metal slide is not desired.

The use of a link to connect the lever to the seat also permits the length of the lower arm of the lever to be increased. It will be apparent that the longer the lower arm is, the longer and more varied one can make the upper cam surface.

Other modifications will be apparent to those skilled in the art and it is not intended that the description of the embodiment, given above for exemplary purposes, be read in a limiting sense, but that the invention be appreciated, as a whole, as defined by the appended claims.

I claim:

1. A control mechanism for controlling the angular adjustment of a seat and backrest of a chair comprising:

(a) a base member having a front end and back end and a longitudinal extent therebetween, said base member being adapted to be mounted on a leg support structure of a chair to be supported thereby in a generally horizontal plane, (b) a seat support member having a front end and a back end in a longitudinal extent therebetween, said seat support member overlying said base member, (c) sliding pivot means connected the front end of the seat support member to the front end of the base member for pivotal movement about a first horizontal axis which extends transversely of the base member and for sliding movement of the seat with respect to the base in the direction of the longitudinal extent of the base between a forward position and a rearward position, the pivotal movement permitting movement of the back end of the seat support with respect to the back end of the base member between an elevated position and a lowered position, (d) a backrest member pivotally mounted at the back end of the base member for movement about a second horizontal axis which extends parallel to said first horizontal axis, said backrest member having a first lever arm projecting from said second axis toward the front end of said base member and a second lever arm which projects upwardly from said second horizontal axis and is adapted to support a backrest at a predetermined height above said seat support member, said backrest member being movable between a first position in which the distal end of the first lever arm is in its lowered position and the distal end of the second lever arm is in a forward position overlying the seat portion ad a second position in which the distal end of the first lever arm is elevated and the distal end of the second lever arm is rearwardly displaced with respect to the seat member, (e) said first lever arm having a longitudinally elongated cam face extending toward its distal end, said cam face underlying said seat support member and having a point of contact bearing against the seat support member, said cam face having a profile such that the radius from the second axis to the point of contact decreases progressively as the seat moves away from its elevated position whereby the moment applied through the first lever arm about the second axis will decrease as the seat member moves from its raised position toward its lower position, (f) a link member having a first end and a second end, the first end of the link member being mounted on the base member for rotation about said second axis, the second end of the link member being pivotally connected to the back end of the seat support, said link arm extending forwardly from the second axis toward the first end of the base member when the seat member is in its lowered position and pivoting upwardly and rearwardly as the back end of the seat member is elevated to simultaneously move the seat support member toward its rearward position as it is elevated to reduce the change in the distance between the distal end of the second lever arm and the back end of the seat rest during relative movement therebetween.

2. A control mechanism as claimed in claim 1, wherein the profile of the cam is such that it provides a flat portion which is spaced a substantial distance from the distal end of the first lever arm which provides a double support for the seat support member when the second lever arm is in a generally upright position.

* * * * *